US005781161A

United States Patent [19]

Kinoshita et al.

[11] Patent Number: 5,781,161

[45] Date of Patent: Jul. 14, 1998

[54] WAVEGUIDE AND MICROSTRIP LINES MODE TRANSFORMER AND RECEIVING CONVERTER COMPRISING A POLARIZATION ISOLATING CONDUCTOR

[75] Inventors: Akira Kinoshita, Osaka; Yoshikazu Yoshimura, Takatsuki, both of Japan

[73] Assignee: Matsushita Electric Industrial Co., Ltd., Osaka, Japan

[21] Appl. No.: 595,954

[22] Filed: Feb. 6, 1996

[30] Foreign Application Priority Data

Feb. 6, 1995 [JP] Japan ..... 7-017400

[51] Int. Cl.[6] ..... H01P 1/17; H01P 5/107

[52] U.S. Cl. ..... 343/750; 333/26; 333/21 A

[58] Field of Search ..... 333/21 A, 26, 333/137; 343/700 MS, 756, 786

[56] References Cited

U.S. PATENT DOCUMENTS

| | | | |
|---|---|---|---|
| 4,827,276 | 5/1989 | Fukuzawa et al. | 343/786 X |
| 4,996,535 | 2/1991 | Profera, Jr. | 333/21 A X |
| 5,374,938 | 12/1994 | Hatazawa et al. | 333/26 X |
| 5,440,279 | 8/1995 | Kinoshita et al. | 333/26 |
| 5,463,407 | 10/1995 | West et al. | 343/786 |

FOREIGN PATENT DOCUMENTS

| | | | |
|---|---|---|---|
| 71069 | 2/1983 | European Pat. Off. | 343/700 MS |
| 0350324 | 1/1990 | European Pat. Off. . | |
| 4213539 | 10/1992 | Germany . | |
| 4207503 | 9/1993 | Germany . | |
| 4305906 | 9/1994 | Germany . | |
| 4305908 | 9/1994 | Germany . | |
| 151801 | 12/1987 | Japan | 333/21 A |
| H3-36243 | 4/1991 | Japan . | |
| 52-26906 | 9/1993 | Japan . | |
| 2256534 | 12/1992 | United Kingdom . | |

*Primary Examiner*—Benny T. Lee
*Attorney, Agent, or Firm*—Ratner & Prestia

[57] ABSTRACT

A mode transformer for a waveguide and microstrip lines capable of obtaining sufficient cross polarization isolation and a receiving converter comprising the same is provided. Transformers of horizontal and vertical polarized waves comprise orthogonal first and second microstrip lines and a circular waveguide. By placing a metal bar connected to the waveguide between the first and second microstrip lines, the metal bar has the ground potential which is the same as the potential of the circular input waveguide and the electric fields excited in the first and second microstrip lines have a polarity that move toward the direction of the metal bar, so that electric field coupling of the first and second microstrip lines may be avoided.

8 Claims, 2 Drawing Sheets

WAVEGUIDE AND MICROSTRIP LINES MODE TRANSFORMER AND RECEIVING CONVERTER COMPRISING A POLARIZATION ISOLATING CONDUCTOR

FIELD OF THE INVENTION

The present invention relates to a mode transformer of waveguide and microstrip line for receiving signals from, for example, a communication satellite, and a receiving converter comprising this mode transformer.

BACKGROUND OF THE INVENTION

Broadcasting and communication utilizing communication satellites are becoming common recently. Radio signal sent from communication satellites consist of both horizontal polarized waves and vertical polarized waves, depending on the changing direction of the electric field for transmitting two programs by one channel.

A conventional waveguide and microstrip line coupling structure used in the satellite receiving converter for receiving the both polarized waves is disclosed, for example, in Japanese Laid-open patent publication No. 3-36243.

In the waveguide and microstrip line coupling structure disclosed in this publication, as shown in FIG. 1A relating to a waveguide and microstrip line coupling structure and FIG. 1B showing section 1B—1B in FIG. 1A, probe antennas 31, 32 for receiving horizontal and vertical polarized waves are disposed so as to be orthogonal to each other in a circular waveguide 1.

In a satellite receiving converter comprising a waveguide and microstrip line, coupling structure as other prior art, as shown in FIG. 2A relating to the structure of a satellite receiving converter comprising a mode transformer for a waveguide and microstrip line, and FIG. 2B showing a sectional view in arrow 2B—2B direction in FIG. 2A, a dielectric substrate 4 (see FIG. 2A) is inserted into a circular waveguide 1, mode transformers 51, 52 for a waveguide and microstrip line are formed by microstrip lines on the dielectric substrate 4 respectively for horizontal polarized waves and vertical polarized waves, and these mode transformers 51, 52 for a waveguide and microstrip line are disposed orthogonally with respect to each other.

In such conventional waveguide and microstrip line coupling structure and satellite receiving converter comprising it, when receiving radio waves from a communication satellite emitting both horizontal polarized waves and vertical polarized waves, both probe antennas for receiving horizontal polarized waves and vertical polarized waves, or both microstrip lines for forming mode transformers for a waveguide and microstrip line for horizontal polarized waves and vertical polarized waves are mutually coupled by electric field, and a sufficient cross polarization isolation cannot be obtained.

The invention is intended to solve this problem, and it is hence a primary object thereof to present a mode transformer for a waveguide and microstrip line and a satellite receiving converter comprising the waveguide and microstrip line mode transformer capable of obtaining a sufficient cross polarization isolation, when receiving radio waves from a communication satellite mixing horizontal polarized waves and vertical polarized waves.

SUMMARY OF THE INVENTION

To achieve the object, the invention provides a mode transformer for a waveguide and microstrip line comprising a circular waveguide, first and second conductors disposed orthogonally, corresponding to horizontal polarized wave and vertical polarized wave, with both ends closely isolated, on a plane perpendicular to the axis of the circular waveguide in the waveguide, and a third conductor at the same potential as the circular waveguide, being disposed closely to each end of the first and second conductors.

The satellite receiving converter of the invention comprises the mode transformer for a waveguide and microstrip line described above.

In this constitution, the third conductor is at the ground potential which is the same as the potential of the circular waveguide, and the electric fields excited in the first and second conductors disposed orthogonally corresponding to the horizontal polarized wave and vertical polarized wave have a polarity going toward the direction of the third conductor, so that coupling of the first and second conductors by electric field does not occur.

PREFERRED EMBODIMENT OF THE INVENTION

Figure 1A:
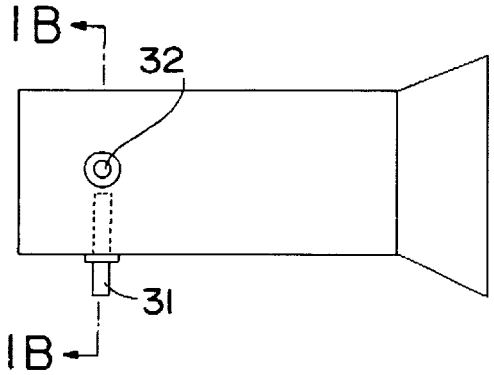
FIG. 1A PRIOR ART
FIG. 1A is a structural side view of coupling of waveguide and microstrip line in one prior art arrangement.
Figure 1B:
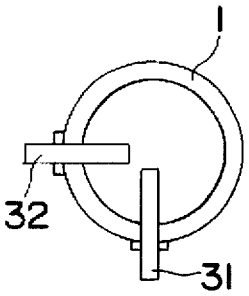
FIG. 1B PRIOR ART
FIG. 1B is a sectional view of arrow 1B—1B direction in FIG. 1A.
Figure 2A:
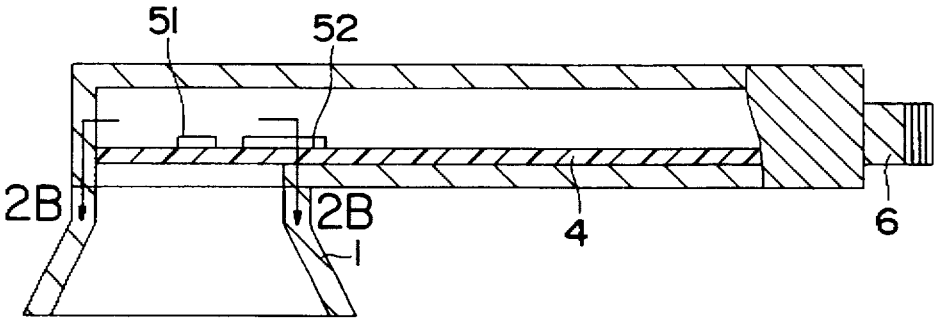
FIG. 2A PRIOR ART
FIG. 2A is a structural side sectional view of a satellite receiving converter having a coupling structure for a waveguide and microstrip line in another prior art arrangement.
Figure 2B:
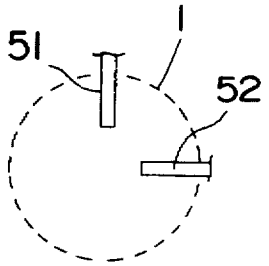
FIG. 2B PRIOR ART
FIG. 2B is a sectional view of arrow 2B—2B direction in FIG. 2A.

Referring now to the drawings, a satellite receiving converter comprising a mode transformer for a waveguide and microstrip line in a preferred embodiment of the invention is described in detail below.

Figure 3:
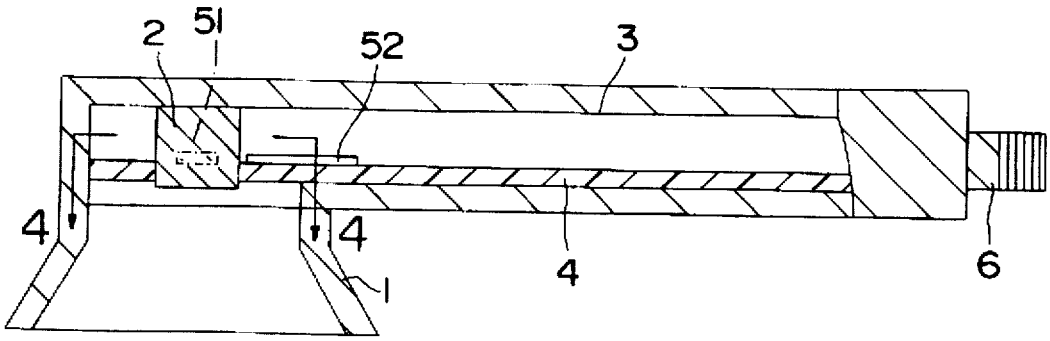
FIG. 3 is a structural side sectional view of a satellite receiving converter comprising a mode transformer for a waveguide and microstrip line in an embodiment of the invention.

FIG. 3 is a structural diagram of the satellite receiving converter comprising the mode transformer for a waveguide and microstrip line of the embodiment. In FIG. 3, a converter casing 3 is disposed closely to an input waveguide 1 which is a circular waveguide, and an insulating substrate 4 is disposed, with one end inserted in the input waveguide 1 and the other end straddling in the converter casing 3. The insulating substrate 4 is arranged to have a plane perpendicular to the axial direction of the input waveguide 1. In the portion of the insulation substrate 4 within the input waveguide 1, microstrip lines 51, 52 which are first and second conductors corresponding to horizontal polarized waves and vertical polarized waves respectively are formed orthogonally, with their ends isolated from each other, thereby forming a waveguide and microstrip line and transformer. A metal bar 2 which is a third conductor is connected at same potential as the input waveguide 1, and penetrates through the insulating substrate 4 and is arranged so as not to contact any isolated end portion of the microstrip lines 51, 52. The insulating substrate 4 is generally composed of dielectric material, and composes a converter circuit in a certain portion in the converter casing 3. The output of the converter circuit is issued from a signal output plug 6.

Figure 4:
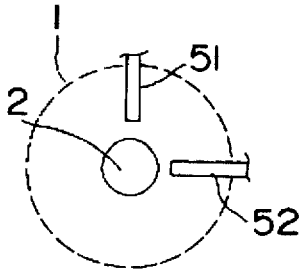
FIG. 4 is a sectional view in arrow 4—4 direction in FIG. 3.

FIG. 4 is a sectional view in arrow 4—4 direction of the satellite receiving converter shown in FIG. 3, and shows the configuration of metal bar and mode transformer for a waveguide and microstrip lines corresponding to horizontal polarized waves and vertical polarized waves on the dielectric substrate, respectively. In FIG. 4, the microstrip line 51 forms the mode transformer for receiving horizontal polarized waves together with the waveguide 1.

The microstrip line 52 forms the mode transformer for receiving vertical polarized waves together with the circular waveguide 1. The microstrip line 51 and microstrip line 52 are arranged orthogonally in a plane perpendicular to the axis of the circular waveguide 1 on the dielectric substrate 4. A hole is opened in the dielectric substrate 4, and the metal bar 2 connected at same potential as the circular waveguide 1 is inserted between the microstrip lines 51 and 52.

In the exemplary satellite receiving converter, the operation is described below.

A radio wave containing horizontal and vertical polarized wave components from a communication satellite enters the circular input waveguide 1, the horizontal polarized wave components are received by the microstrip line 51 for receiving horizontal polarized waves, and the vertical polarized wave components are received by the microstrip line 52 for receiving vertical polarized waves.

Corresponding to the received polarized wave components, electric fields are excited respectively in the microstrip lines 51, 52, and between the microstrip lines 51, 52, there is the metal bar 2 of same potential as the input waveguide 1, close to but not contacting with the microstrip lines 51, 52, and hence the excited electric fields of the microstrip lines 51, 52 are immediately directed to the nearby metal bar 2, so that the microstrip lines 51, 52 are not coupled with each other through the electric fields.

In this operation, when receiving radio waves from communication satellite containing both horizontal polarized waves and vertical polarized waves, a sufficient cross polarization isolation may be obtained.

Thus, according to the invention, the metal bar is at the ground potential which is the same as the potential of the circular waveguide, and the electric fields excited in each microstrip line for forming the mode transformer between the waveguide and microstrip lines corresponding to horizontal polarized waves and vertical polarized waves have a polarity going toward the metal bar, so that mutual coupling of the microstrip lines through electric fields may be avoided.

As a result, when receiving radio waves from communication satellite containing both horizontal polarized waves and vertical polarized waves, a sufficient-cross polarization isolation may be obtained.

In the embodiment, the first and second conductors may be also realized by conductors as in the prior art, instead of the microstrip lines formed on an insulating board.

The case of receiving radio waves from communication satellite is explained herein, but the invention is not limited to reception from communication satellite, but may be modified within the claimed scope, not limited to the illustrated embodiment alone.

We claim:

1. A mode transformer for a waveguide and microstrip lines comprising:

a circular waveguide having an axis extending along an axial direction thereof, first and second conductors disposed orthogonally relative to each other in said circular waveguide, corresponding to a horizontal polarized wave and a vertical polarized wave received by said circular waveguide, respectively, on a plane which is perpendicular to the axis of the circular waveguide, the first and second conductors corresponding to a first and second microstrip line, respectively, each of the first and second conductors having a respective end, the respective ends of the first and second conductors being closely disposed to, and physically separated from each other;

a converter casing situated adjacent said circular waveguide and including a receiving portion at which at least one of said horizontal polarized wave and said vertical polarized wave respectively received from said circular waveguide are directed, a third conductor electrically coupled to the circular waveguide, extending along the axis of said circular waveguide, at least penetrating through the plane on which the first and second conductors are disposed and physically separated from each of the first and second conductors, and a substrate on which the first and second conductors are disposed perpendicular to the axis of said circular waveguide, the substrate located in said converter casing and extending into said receiving portion of said converter casing, the substrate having an opening through which said third conductor passes.

2. A mode transformer according to claim 1, wherein the third conductor is a metal bar.

3. A mode transformer according to claim 1, wherein the substrate is a dielectric material.

4. A mode transformer according to claim 3, wherein the third conductor is a metal bar.

5. A receiving converter having a mode transformer for a waveguide and microstrip lines comprising:

a circular waveguide having an axis extending along an axial direction thereof, first and second conductors disposed orthogonally relative to each other in said circular waveguide, corresponding to a horizontal polarized wave and a vertical polarized wave received by said circular waveguide, respectively, on a plane which is perpendicular to the axis of said circular waveguide, the first and second conductors corresponding to a first and second microstrip line, respectively, each of the first and second conductors having a respective end, the respective ends of the first and second conductors being closely disposed to, and physically separated from each other, a converter casing situated adjacent said circular waveguide and including a receiving portion at which at least one of said horizontal polarized wave and said vertical polarized wave respectively received from said circular waveguide are directed, a third conductor electrically coupled to the circular waveguide, extending along the axis of said circular waveguide, at least penetrating through the plane on which the first and second conductors are disposed and physically separated from each of the first and second conductors, and a substrate on which the first and second conductors are disposed perpendicular to the axis of said circular waveguide, the substrate located in said converter casing and extending into said receiving portion of said converter casing, the substrate having an opening through which said third conductor passes.

6. A receiving converter according to claim 5, wherein the substrate is a dielectric material.

7. A receiving converter according to claim 6, wherein the third conductor is a metal bar.

8. A receiving converter according to claim 5, wherein the third conductor is a metal bar.

* * * * *

UNITED STATES PATENT AND TRADE MARK OFFICE

CERTIFICATE OF CORRECTION

PATENT NO. : 5,781,161
DATED : July 14, 1998
INVENTOR(S) : Kinoshita et al.

It is certified that error appears in the above-identified patent and that said Letters Patent is hereby corrected as shown below:

On the cover page, item [56] References Cited, U.S. Patent Documents, add -4,460,894 7/1984 Robin et al.--

Signed and Sealed this

Twenty-third Day of March, 1999

*Attest:*

Q. TODD DICKINSON

*Attesting Officer*

*Acting Commissioner of Patents and Trademarks*